United States Patent [19]

Florence

[11] Patent Number: 4,982,533

[45] Date of Patent: Jan. 8, 1991

[54] DRYWELL WITH PLUGS, DRYWELL SYSTEM AND METHOD FOR CONTROLLING THE FLOW AND DIRECTION OF SURFACE WATER

[76] Inventor: Thomas Florence, 817 Shoot Flying Hill Rd., Centerville, Mass. 02632

[21] Appl. No.: 407,361

[22] Filed: Sep. 14, 1989

Related U.S. Application Data

[63] Continuation-in-part of Ser. No. 394,635, Aug. 16, 1989, Pat. No. 4,983,069.

[51] Int. Cl.[5] ..... E02B 11/00; E02B 19/00; E03F 5/02

[52] U.S. Cl. ..... 52/169.5; 52/16; 210/165; 285/901; 405/51; 405/36

[58] Field of Search ..... 52/169.5, 16; 405/51, 405/36; 210/165; 285/901, 12

[56] References Cited

U.S. PATENT DOCUMENTS 3,428,077 2/1969 Scarfe ..... 52/169.5 X
4,031,009 6/1977 Hicks ..... 405/36 X
4,298,294 11/1981 Zimmerman ..... 52/169.5 X
4,620,817 11/1986 Cushing ..... 52/16 X

FOREIGN PATENT DOCUMENTS 2031480 4/1980 United Kingdom ..... 210/165

*Primary Examiner*—Richard E. Chilcot, Jr.
*Assistant Examiner*—Deborah McGann Ripley
*Attorney, Agent, or Firm*—Richard P. Crowley

[57] ABSTRACT

An improved drywell system and method of controlling the flow and distribution of surface water employing a drywell, the drywell including a cylindrical drywell adapted to be positioned beneath the ground, which drywell has at least one large diameter port in the cylindrical wall of the drywell to receive or discharge surface and a plurality of smaller diameter distribution ports, generally uniformly distributed about the cylindrical wall surface of the drywell and a removable bottom cover and a removable top cover, the small diameter distribution ports having a conical shape to receive tapered plugs, the plugs adapted to be easily removed or installed prior to use by selection of the plug so that the direction and distribution of the flow of surface water beneath the surface may be controlled.

15 Claims, 1 Drawing Sheet

DRYWELL WITH PLUGS, DRYWELL SYSTEM AND METHOD FOR CONTROLLING THE FLOW AND DIRECTION OF SURFACE WATER

This application is a continuation-in-part of application Ser. No. 07/394,635, filed Sept. 16, 1989, now U.S. Pat. No. 4,983,069 issued Jan. 8, 1991.

BACKGROUND OF THE INVENTION

The control and flow of surface water, such as rain water, is important in preventing the build up of surface water adjacent foundations or other structures and prevention of migration of water causing dampness in cellars contained therein. Generally, drywells are employed to receive large quantities of surface water therein and to permit the discharge of surface water beneath the ground and away from the foundation wall or structure and over a defined area. Typically, a drywell would be located a distance from the foundation in a suitable drain field containing permeable soil to facilitate the removal of wastewater from the vicinity of the foundation.

As building sites have becomes scarcer with respect to demand, foundations are increasingly located on area of poor drainage, such as on rock ledges and areas of marginal or poor permeability. In such cases, it is particularly desirable to select the best available zone, sector, level or direction to insure that the surface water is distributively removed from the soils adjacent the foundation walls and directed toward flow paths in permeable soil strata and is prevented from back flowing toward the foundation.

Often, drywell may comprise a precast type plastic or precast concrete, a hole for an inlet pipe and a plurality of holes already precast in the cylindrical walls to permit the drainage of water radially outward therefrom. Often the simple and effective drywell constitutes a metal drum, such as a 55 gallon drum, with holes perforated in the metal sides thereof, and the drum filled with loose stones and rocks and a grate placed on top thereof or a drain pipe directing water into the side of the drywell. It is desirable however to provide for an improved, simple, yet effective, drywell to provide for the improved control, accumulation and flow or direction of the surface water and to a drywell system which uses the improved drywell and to a method of controlling the flow and direction of surface water.

SUMMARY OF THE INVENTION

The present invention is directed to an improved drywell and to a drywell system employing the improved plastic drywell with plugs and to a method of controlling the flow and accumulation and distribution of surface water employing the improved plastic drywell with plugs of the invention.

The present invention comprises an improved drywell with plugs which includes a plastic or precast concrete, cylindrical drywell adapted to be positioned beneath the ground and to receive collectively surface water or liquids therein for distribution over a different area or different level or strata in the ground. The drywell has at least one large diameter port in the cylindrical wall of the drywell to collectively receive or discharge, optionally both, the surface water and a plurality of smaller diameter distribution type ports generally uniformly distributed about the cylindrical wall surface of the drywell, and closure means, such as a plurality of plugs, received by the larger and smaller ports for selectively sealing off the flow of water therethrough and a removable bottom cover and a removable top cover.

The drywell comprises a molded plastic, wherein distribution ports are formed with openings adapted to receive tapered plugs, optionally held in place by adhesive tape or an adhesive, so that the said plugs are adapted to be easily removed or alternatively, installed prior to use. The ports, which may be frustoconically shaped, are typically formed during the molding or manufacturing process of preparing the plastic drywell or may be drilled in a metal drum and generally would comprise a series of small, molded ports or predrilled ports of the plastic material formed in the outer peripheral, surrounding cylindrical wall of the drywell. The openings in the plastic drywell may comprise a straight wall opening drilled or where molded comprises a frustoconical-shaped aperture, spaced apart and having a large inner diameter and a smaller outer diameter surrounding the cylindrical wall of the drywell with the large diameter on the interior wall surface of the drywell container.

The plugs which may be frustoconically shaped typically are fastened in place in the ports by glue or adhesive, and the user may at installation selectively remove said plugs as desired on the cylindrical wall so that the control, direction and the amount of flow, as well as the level of flow of the surface water or discharge from the drywell is controlled. Generally, and particularly where the plug is frustoconical, the plug should be inserted from the inside of the drywell where the inside water pressure will force and retain the plug in position without the need for adhesives. Such control may be an arcuate flow between 60° and 120° or more in one direction or to select drain ports at one or multiple levels or to remove randomly plugs, it so desired, to permit the surface water to emanate generally peripherally about the drywell. In any event, the employment of removable plugs permits the user to have flexibility in deciding what drain distribution ports to be removed and to control the direction, level and flow of water beneath the ground.

The drywell also includes a removable top cover. In one embodiment, the drywell contains a grate opening and a grate in the grate opening so that the top surface of the drywell may be placed generally flush or slightly below the ground level so that the surface water may be received through the grate and additionally, if desired, the drywell would include a larger diameter port with a large plug so that upon removal of the plug, a pipe may be inserted in the cylindrical drywell so that the drywell may receive water directly from a pipe. In addition, of course, the drywell may include an additional large diameter port, generally on the opposite side from the first large diameter port, with a large plug so that if desired the drywell may be connected in series the pipe extending between the first and second drywell. As also contemplated by the invention, the improved drywell may be employed in series, generally vertically above, beneath the ground with the top or bottom section as desired removed between the intervening, vertically stacked drywells so as to permit the vertically stacked drywells to act as an integral drywell unit.

The plastic drywell of the invention may be employed in a drywell system whereby surface water is directed into the large diameter port or into the top surface of both of the drywells. Typically, the plastic drywell would include one, or preferably two or three, large diameter ports, approximately four to eight inches in diameter, with preformed, large ports as well as a plurality of smaller diameter distribution ports, generally uniformly distributed throughout the body of the plastic drywell and typically ranging in size from one to three inches in diameter and positioned from four to six inches from each other, substantially all having tapered plug inserts.

The plugs may be furnished separately to the user for installation after the drywell is installed and prior to filling the drywell with particulate material. The drywell may be employed with or without the employment of loose fill aggregate material therein and generally includes a solid bottom cover which may be removed if desired in vertically stacking to increase the drainage of surface water, and a removable plastic top cover which may contain a grate opening therein or may be solid.

The improved drywell is adapted to be employed in a variety of system wherein water, but more particularly surface water, is to be received and distributed, such as water from the gutter system of a house or from a driveway. However it is recognized the improved drywell may be employed in any situation where it is desirable to receive a liquid and to distribute a liquid over a defined area with control of the direction or flow of the liquid permitted by the selective removal or addition of tapered plug inserts in the large and small diameter distribution ports in the cylindrical wall of the drywell. The plastic drywell can be composed of a wide variety of plastic or polymeric materials or concrete, but typically is formed of a hard, molded plastic which permits the integral molding of the large port and smaller distribution ports to provide for a simple, inexpensive drywell. Typical materials which may be employed would include polyethylene, polypropylene, ABS resin, polycarbonates and other polymeric materials.

The plastic drywell drainage system for the subterranean distribution of surface water would comprise a water source of surface water to be subterraneally flow directed away from the water source, such as the foundation of a house, the water source being the rain water distributed from a gutter system from the roof of a structure, the plastic cylindrical drywell positioned beneath the ground, underground pipe means to direct the flow of surface water from the water source into the drywell or a grate in the top surface of the drywell, and the surface water directed into the improved drywell through the grate which is placed generally flush or slightly below the surface of the ground or below the section to receive the water.

The invention also includes a method for the controlled flow of water or other liquid, particularly surface water, from a water or liquid source, which method would comprise providing the improved plastic, cylindrical drywell and removing a plurality of the tapered plug inserts of the distribution ports, and optionally, the larger diameter ports as required to provide for the desired direction and flow of the water from the interior of the plastic drywell, and then installing the drywell so that the top cover is flush or below the ground surface, depending upon whether the water is to be received through a grate or from a pipe, and then directing the water, typically surface water, into the interior of the drywell and from the drywell out the distribution ports in the desired direction as selected by the removal of the plug and at the desired level as also determined by the selection of the distribution ports as the various levels in the plastic drywell.

The invention will be described for purpose of illustration only in connection with certain embodiments; however, it is recognized that those persons skilled in the art may make various changes modifications, improvements and additions on the illustrated embodiments, all without departing from the spirit and scope of the invention.

DESCRIPTION OF THE EMBODIMENTS

Figure 1:
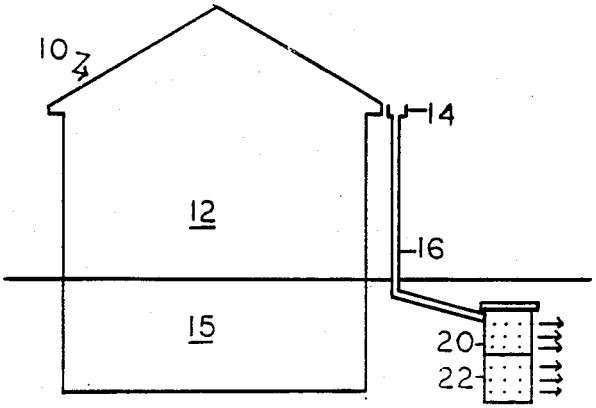
FIG. 1 is a schematic, illustrative, sectional view of the drainage system of the invention showing the employment of the improved drywell.

With reference to the drawings, FIG. 1 shows a drainage system 10, including a structure 12, a gutter 14 and a foundation 15, a drainpipe 16 which extends from the gutter downwardly into the ground and into a plastic drywell of the invention 20 which has been placed above another plastic drywell of the invention 22 in a generally vertical alignment, with the top cover of 22 removed and the top cover of 20 in place and the bottom cover of 22 in place. As illustrated in FIG. 1, on the left hand side of the structure 12, water flowing from the roof drops to the ground and may be directed toward the lower section of the foundation. On the right hand side of FIG. 1 is a typical structure 12, a gutter 14 and a drain pipe 16, the drain pipe 16 beneath the ground, angled away and going into an inlet port of the top plastic drywell 20. The arrows indicate the direction of flow as emanating from the two drywells 20 and 22 and showing the flow from the distribution port 23 directed away from the structure 12 by the selection of the tapered plugs 25 to be removed from drain ports on that side of the drywells 20 and 22 thereby directing and controlling the surface water from the roof away from the structure into desired permeation areas and ground strata.

Figure 2:
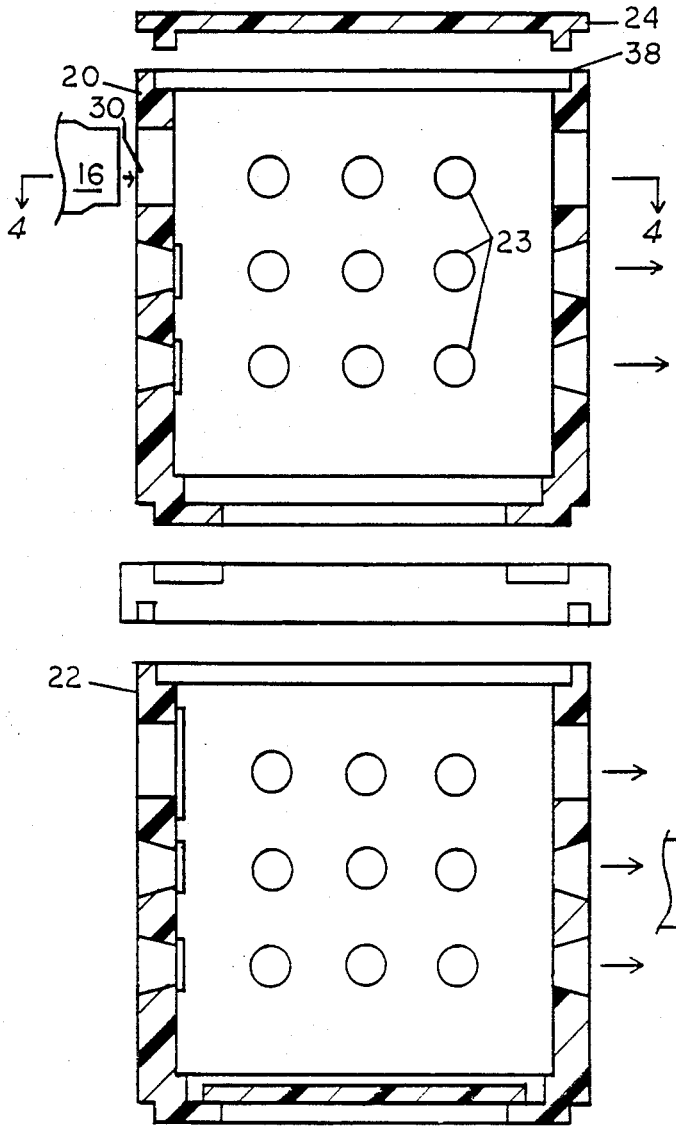
FIG. 2 is a side elevational, partially exploded view of the improved drywell of the invention as employed in FIG. 1.

FIG. 2 illustrates the plastic drywell having a removable top cover 24 and a removable bottom cover 26, the top cover 24 having outwardly extending flanges which fit into a female flange about the top peripheral wall surface of cylindrical wall 38 of the drywell 20, while the removable bottom cover 26 is designed to fit into a male flange on the lower surface of the drywell 20. The plastic drywell 20 includes a large diameter port 30 shown without a plug insert and with the drain pipe 16 adapted to be placed therein. The plastic drywell 20 also includes a plurality of small diameter distribution ports 23 with conical openings, the drywell integrally molded of a plastic type material. As illustrated in FIG. 2, the plug inserts have been removed to provide open distribution ports 23 in the cylindrical wall 38 of the drywell 20, all in the right hand side of the drywell 20. In one embodiment, the drywell 20 would have a height of approximately 24 inches and a diameter of 30 to 36 inches, and with the large diameter ports 30, shown without plug inserts, typically four to six inches, and with large diameter port 36 shown with the plug insert, as in place for a possible discharge port of similar size, though the sizes of the ports may vary as well as their position. The smaller distribution port may vary as well as their position. The smaller distribution ports 23 generally range from two to four inches in diameter and are placed from four to six inches apart and are generally illustrated as uniformly distributed throughout the wall 28 of the drywell 20.

Figure 3:
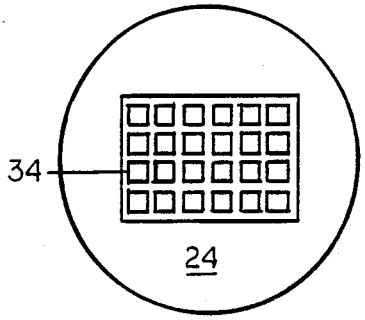
FIG. 3 is a top plan view of the improved drywell of the invention with a grate on the top cover.

As illustrated more particularly in FIG. 3, the top cover 24 may contain a grate opening therein and a grate 34 positioned therein which permits the plastic drywell 20 to stand alone as a single piece drywell installation to receive surface water in low locations, such as driveway valleys, the surface water entering into the grate, then into one ore more large diameter ports 30.

Figure 4:
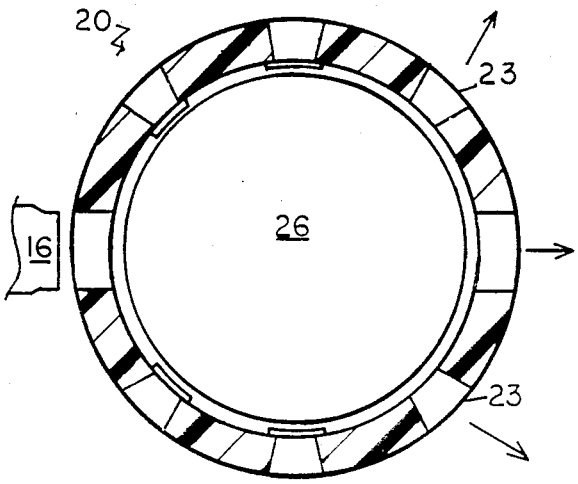
FIG. 4 is a top plan view of a section of the improved plastic drywell of the invention in the drainage system.

FIG. 4 is a top plan view of a section of the improved plastic of the tapered plug from the smaller diameter drain ports arrows, away from the inlet pipe 16 which discharges surface water into the plastic drywell 20.

The improved plastic drywell, the drywell system and the method of installation and use provide for an easy, effective and simple method of controlling the flow and direction of surface water and permits flexibility of the user to select desired large or small diameter ports for distribution of water. Of course, as recognized, the improved plastic drywell may include not only large and small diameter ports, but a whole series of ports of different diameters and distribution in the walls of the plastic drywell as desired in order to permit the control and flow and distribution of surface water.

What is claimed is:

1. A drywell drainage system for the subterranean collection and distribution of surface water to a drain field or water deficient-user lawn or garden system, which system comprises:

(a) a water source of surface water to be collected and subterraneally flow-distributed away from the water source;

(b) a cyindrical drywell positioned beneath the ground and having a cylindrical wall;

(i) at least one large diameter inlet or outlet port in the cylindrical wall of the drywell to receive or discharge the surface water;

(ii) a plurality of distribution ports having a smaller diameter than the said large diameter port generally uniformly distributed about the periphery and the length of the cylindrical wall surface of the drywell;

(ii) a removable bottom cover;

(iv) a removable top cover; and (v) a plurality of enclosure plug means for use in plugging a selected number of the smaller diameter distribution ports, the plugs adapted to be easily installed in or removed from the distribution ports prior to use of the drywell whereby on selection of the drain ports, the direction, level and distribution pattern of the flow of surface water discharged from the cylindrical wall of the drywell may be controlled by the selection of the plugs installed or removed;

(c) means to direct the flow of surface water from the water source into the drywell.

2. The system of claim 1 wherein the enclosure plug means comprises frustoconical-shaped plugs adapted to be readily received in the selected distribution ports.

3. The system of claim 1 wherein the inlet port has a diameter of about four inches or greater, and the distribution ports have a diameter of about two to three inches.

4. The system of claim 1 wherein the bottom cover has been removed to permit surface water to drain from the bottom of the drywell.

5. The system of claim 1 wherein the bottom cover is provided with a plurality of distribution ports.

6. The system of claim 1 wherein the top cover is characterized by an opening therein to receive a grate.

7. The system of claim 4 wherein the top cover includes a grate, the top cover and grate generally flush with or slightly below the ground surface.

8. The system of claim 1 wherein an inlet port is positioned on one side wall of the drywell and the distribution ports with removed plugs are on the opposite side of the inlet port to permit water flow in a general arcuate pattern of 60° to 120° section of the cylindrical wall of the drywell.

9. The system of claim 1 wherein the plug enclosure means are adhesively secured in the selected distribution ports.

10. The system of claim 1 wherein the enclosure plug means are positioned on the interior wall of the drywell.

11. The system of claim 1 which includes a plurality of drywells arranged generally vertically one on top of the other with the top or bottom cover removed to permit the vertical flow of water between adjacently arranged drywells.

12. A plastic, cylindrical drywell for use in a drywell system for the accumulation and controlled flow of surface water, which drywell having a cylindrical wall comprises:

(a) at least one large diameter port in the cylindrical wall of the drywell to receive or discharge surface water from a surface water source;

(b) a plurality of distribution ports having a smaller diameter than the said large diameter port generally uniformly distributed about the periphery and length of the cylindrical wall surface of the drywell;

(c) a removable bottom cover;

(d) a removable top cover;

(e) a plurality of frustoconical shaped enclosure plugs adapted to seal selected distribution ports;

(f) the smaller diameter ports having distribution ports having frustoconical shaped openings to receive said enclosure plugs; and (g) the plugs adapted to be easily installed in or removed from the drain ports prior to use whereby on selection of the drain ports, the direction, level and distribution pattern of the flow of surface water discharged from the drywell may be controlled by the selection of the plugs installed or removed.

13. A method for the accumulation and controlled flow of surface water from a surface water source, which method comprises:

(a) providing a cylindrical drywell having a cylindrical wall to receive surface water, the drywell comprising:

(i) at least one large diameter port in the cylindrical wall of the drywell to receive or discharge surface water from a surface water source;

(ii) a plurality of distribution ports having a smaller diameter than the said large diameter port generally uniformly distribution about the periphery and the length of the cylindrical wall;

(iii) a removable bottom cover;

(iv) a removable top cover;

(v) a plurality of enclosure plug means to use in plugging a selected number of the distribution ports;

(vi) distribution ports having openings to receive a plurality of tapered plugs;

(vii) the plugs adapted to be easily installed in or removed from the drain ports prior to used whereby on selection of the drain ports, the direction, strata level or ground and distribution pattern of the flow of surface water discharged from the drywell may be controlled by the selection of the plugs installed or removed; and (b) removing or installing a plurality of the enclosure plugs from or into the distribution ports to provide the desired direction, level and distribution pattern of flow of the surface water from the distribution ports;

(c) installing the drywell so that the top cover is flush or below the ground surface; and (d) directing surface water into the interior of the drywell.

14. The method of claim 13 which includes forming the distribution ports and enclosure plugs of a frustoconical shape and sealing initially the frustoconical shaped enclosure plug into the selected distribution ports on the interior wall of the drywell.

15. The method of claim 13 which includes adhesively sealing the enclosure plug into the selected distribution ports.

* * * * *